United States Patent [19]

Draper

[11] Patent Number: 4,976,227

[45] Date of Patent: Dec. 11, 1990

[54] INTERNAL COMBUSTION ENGINE INTAKE AND EXHAUST VALVE CONTROL APPARATUS

[76] Inventor: David J. Draper, 8640 Heathersett, Brighton, Mich. 48116

[21] Appl. No.: 509,882

[22] Filed: Apr. 16, 1990

[51] Int. Cl.[5] ..... F01L 7/00; F16K 31/02

[52] U.S. Cl. ..... 123/80 R; 123/190 R; 123/190 A; 251/129.11; 251/65

[58] Field of Search ..... 123/80 BA, 80 R, 190 R, 123/190 A, 190 B, 190 BD, 190 BF; 251/129.11, 65

[56] References Cited

U.S. PATENT DOCUMENTS

| | | | |
|---|---|---|---|
| 3,347,262 | 10/1967 | Gibson | 137/375 |
| 3,948,227 | 4/1976 | Guenther | 123/80 BA |
| 4,077,382 | 3/1978 | Gentile | 123/190 R |
| 4,494,517 | 1/1985 | Kratt et al. | 123/585 |
| 4,546,743 | 10/1985 | Eickmann | 123/190 A |
| 4,580,761 | 4/1986 | Silcox et al. | 251/129 |
| 4,682,574 | 7/1987 | Kreuter | 123/90.11 |
| 4,744,543 | 5/1988 | Renheim | 251/65 |
| 4,829,947 | 5/1989 | Lequesne | 123/90.11 |
| 4,879,979 | 11/1989 | Triguero | 123/190 BB |
| 4,887,567 | 12/1989 | Matsuura et al. | 123/190 D |

FOREIGN PATENT DOCUMENTS

| | | | |
|---|---|---|---|
| 0037382 | 3/1983 | Japan | 251/129.11 |
| 0160678 | 9/1983 | Japan | 251/129.11 |
| 0073679 | 4/1984 | Japan | 251/129.11 |
| 2114654 | 8/1983 | United Kingdom | 123/190 R |

*Primary Examiner*—Charles J. Myhre
*Assistant Examiner*—Weilun Lo
*Attorney, Agent, or Firm*—Basile and Hanlon

[57] ABSTRACT

An intake and exhaust valve control apparatus includes a pair of valves rotatably disposed in a body mounted in association with a cylinder of an internal combustion engine. Each valve includes a through bore selectively disposed between ports in the body in fluid flow communication with the cylinder. Magnets of opposed polarity are mounted on one end of the valve. A magnetically coupled core and coil are associated with the magnets and are positioned to repel and attract certain of the magnets to rotate the valve between first and second positions when current flows in one of two directions in the coil and induces a magnetic field in the core. The coil is connected to a control module which supplies electric currents in opposed directions at predetermined times in the engine cycle to rotate the valves between fluid flow and fluid blocking positions with respect to the cylinder.

10 Claims, 3 Drawing Sheets

INTERNAL COMBUSTION ENGINE INTAKE AND EXHAUST VALVE CONTROL APPARATUS

BACKGROUND OF THE INVENTION

1. Field of the Invention

This invention relates, in general, to internal combustion engines, and specifically, to intake and exhaust valve systems for internal combustion engines. 2. State of the Art An internal combustion, four-stroke engine contains a cylinder head, a plurality of cylinders each having a piston reciprocally mounted therein, and intake and exhaust valves associated with each cylinder. The intake and exhaust valves control the flow of fuel into the combustion chamber of the cylinder as well as the exhaust of combustion gases from the cylinder on a time basis.

Timing is achieved by the use of one or more cams, valve lifters, push rods, rocker arms, rocker arm shafts, valve guides and a cam timing chain or belt. These intake and exhaust valve components form a complex mechanical system which contains a large number of individual parts. The mechanical system also has considerable weight which is a disadvantage when high fuel economies are desired. Further, due to the numerous components, such mechanical systems have a high manufacturing cost and require continuous maintenance and repair, as well as a considerable number of spare parts.

Certain attempts to overcome these problems and reduce the number of components in the intake and exhaust valve train have utilized a single rotary shaft in which a series of ports or bores are formed at various angles along the length of the shaft. Two of the ports in the shaft are disposed in fluid flow communication with each cylinder of the engine and provide timed intake and exhaust of fuel and combustion gases to and from the cylinder as the shaft rotates. However, the rotation of such rotary shafts are still effected by mechanical means including belts, pulleys, etc., which are connected to the engine crankshaft.

Thus, it would be desirable to provide an intake and exhaust valve system for an internal combustion engine which overcomes the aforementioned problems associated with previously devised intake and exhaust structure. It would be desirable to provide an intake and exhaust valve system for an internal combustion engine which has a minimum number of individual components for a low manufacturing cost, low weight, low volume or space requirements, and high efficiency. It would also be desirable to provide an intake and exhaust system for an internal combustion engine in which valve timing is effected solely by electrical means, rather than mechanical means.

SUMMARY OF THE INVENTION

The present invention is an intake and exhaust valve control apparatus for an internal combustion engine. The intake and exhaust valve control apparatus is used in conjunction with an internal combustion engine having a piston reciprocally mounted in a cylinder. A rotatable valve having a through bore rotates between first and second positions in a body and is disposed in fluid flow communication with the cylinder only in one of the first and second positions. The apparatus comprises first and second magnet means of opposed polarity mounted on the valve in a circumferentially spaced relationship. A magnetic core is mounted in magnetic coupling relationship with the first and second magnet means. A coil wound in a plurality of winding turns is disposed about the magnetic core and induces a magnetic field in the core having a first magnetic orientation when an electrical current having a first direction flows through the coil. A control means is connected to the coil and generates electrical currents of alternating directions in the coil to induce magnetic fields in the core having one of two opposed magnetic field orientations to cause selective rotation of the magnet means and the valve between first and second positions in which the through bore in the valve alternates between fluid flow communicating and blocking positions between inlet and outlet ports formed in the body surrounding the valve.

In a preferred embodiment, the magnet means comprises two radially opposed magnets of a first polarity and two radially opposed magnets of a second polarity. One of the second magnets are interposed between the first pair of magnets. First and second magnetic cores are mounted in a magnetic coupling relationship with a pair of the first and second adjacent magnets. The magnets preferably are permanent magnets affixed to one end of the valve. Coils are wound in a plurality of winding turns about each of the first and second magnetic cores and connected to the control means.

In a specific embodiment, the intake and exhaust valve control apparatus comprises a body mounted on an internal combustion engine adjacent one cylinder of the engine. The body has vertical inlet and outlet ports which extend therethrough in communication with the cylinder in the engine. First and second horizontally extending through bores are formed in the body. First and second rotary valves are rotatably mounted in the first and second bores, respectively. Each of the valves has a through bore extending therethrough substantially perpendicular to the axial length of each valve. Magnet means of opposed polarity is mounted on one end of each of the valves and extends outward from the body. A magnetic core means is mounted on the body and disposed in magnetic relationship with the magnet means. Coils wound about the magnetic core are connected to the control means which generates electrical currents of predetermined opposed directions and duration in the coils to induce a magnetic field in the magnetic core means and cause selective rotation of the magnet means and the attached valve between first and second positions.

The control means, by generating electrical currents in opposed directions in the coils wound about the magnetic cores, selectively causes the valves to rotate between fluid flow and fluid blocking positions on a timed basis with reciprocation of the piston in the cylinder. Thus, the sole means for rotating the valves is electrical in nature thereby eliminating the substantial mechanical structure previously employed in internal combustion engines which includes cams, valve springs, timing gears, lifters, push rods, rocker arms, rocker arm shafts, valve guides, etc. This eliminates substantial weight and volume requirements in an engine and enhances the fuel efficiency of the engine. Further, the minimal number of components employed in the apparatus of the present invention reduces the manufacturing cost of the engine as well as reducing maintenance and repair costs and extending the useful life of the engine.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
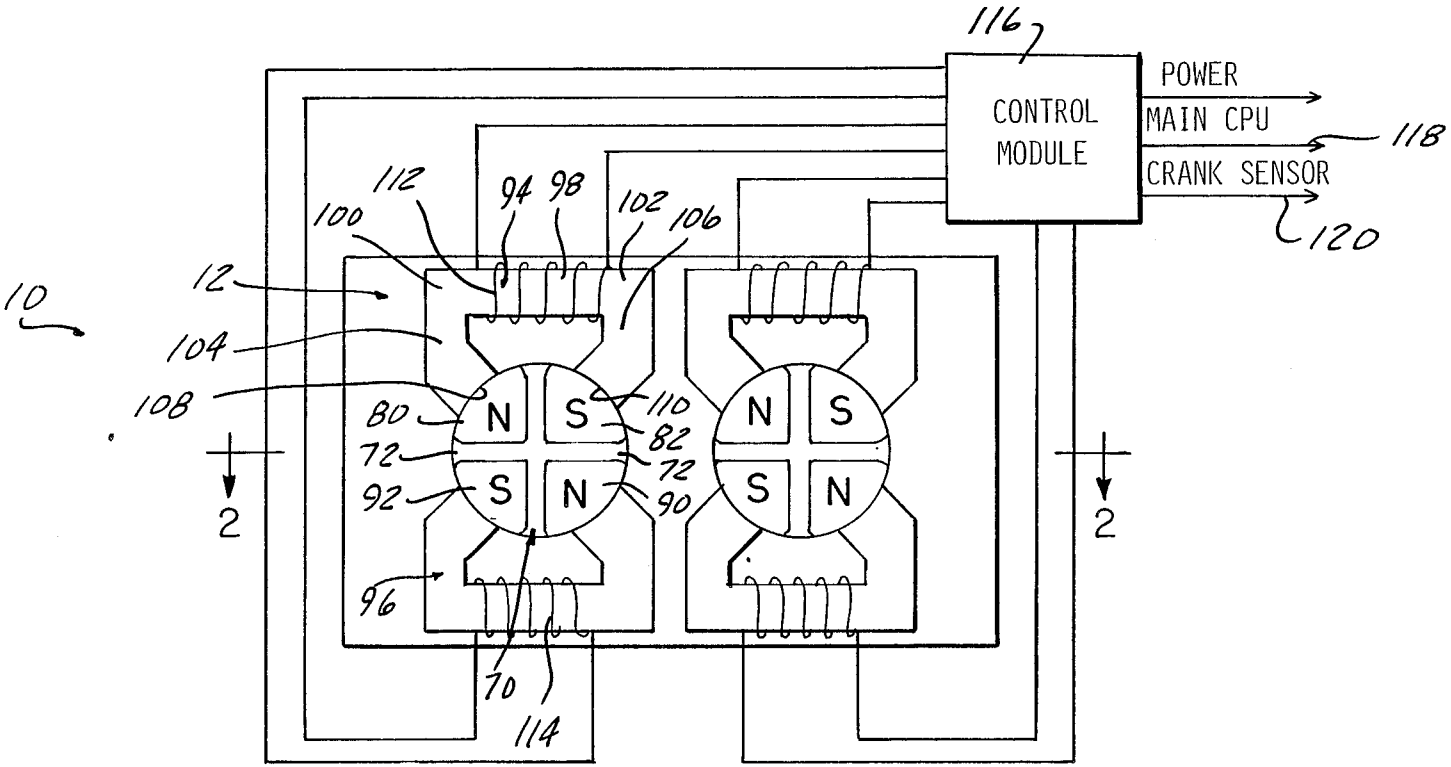
FIG. 1 is a side elevational view of the intake and exhaust valve control apparatus of the present invention.

Throughout the following description and drawing, an identical number is used to refer to the same component shown in multiple figures of the drawing.

Referring now to the drawing, and to FIG. 1 in particular, there is illustrated an internal combustion engine intake and exhaust valve control apparatus 10. The apparatus 10 eliminates substantially all of the mechanical components normally found in the intake and exhaust valve train employed in internal combustion engines, including, for example, cams, valve springs, lifters, push rods, rocker arms, rocker arm shafts, valve guides, cam chain, etc.

Figure 2:
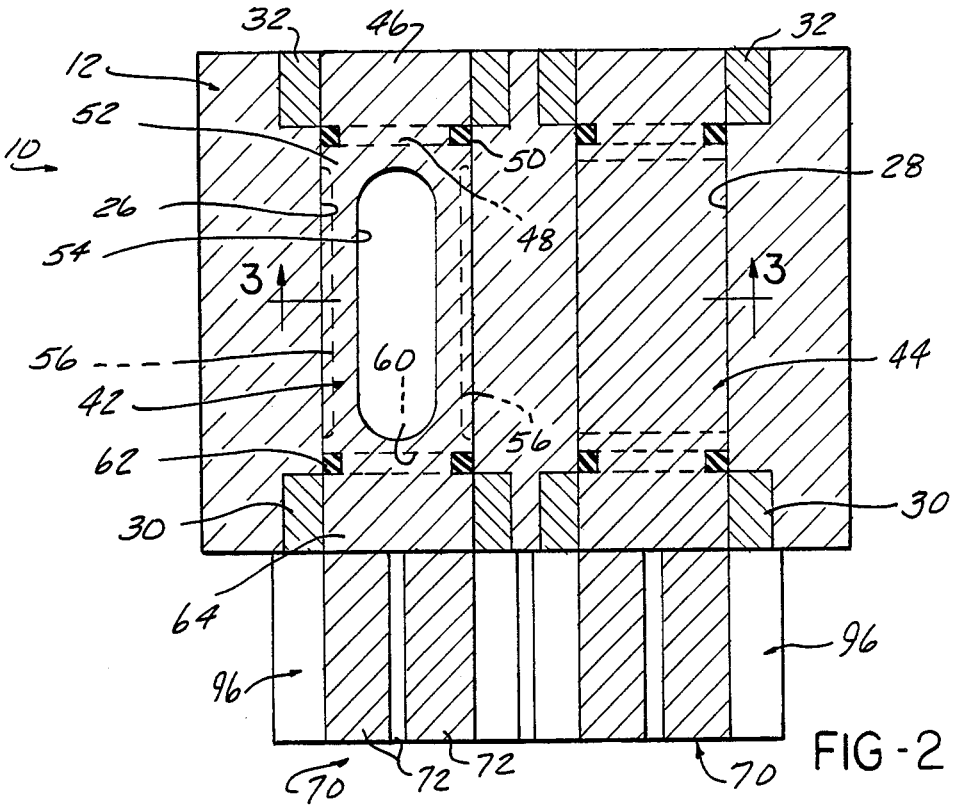
FIG. 2 is a cross sectional view generally taken along line 2—2 in FIG. 1 and showing the apparatus of the present invention in plan.
Figure 3:
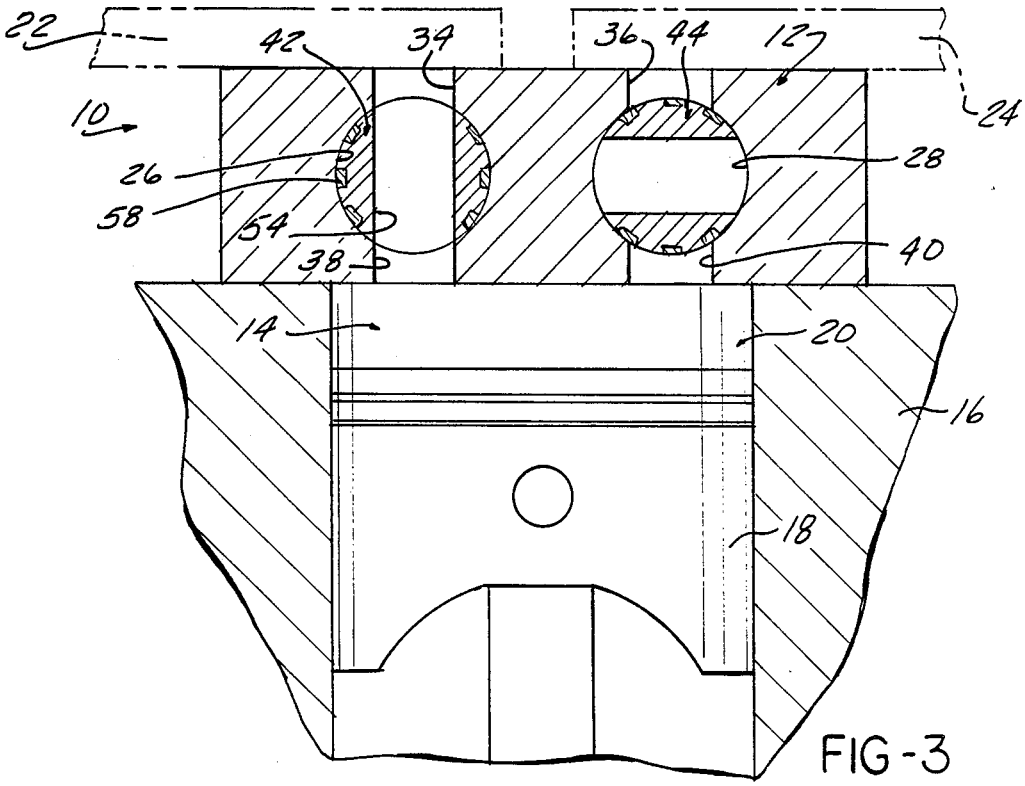
FIG. 3 is a cross sectional view generally taken along line 3—3 in FIG. 2.

As shown in FIGS. 1, 2, 3 and 4, the apparatus 10 includes a body 12 preferably formed of a suitable high strength, high temperature resistant material, such as a cast or machined metal, ceramic, etc. One body 12 is associated with each cylinder 14 of an internal combustion engine, as shown in FIG. 3. The body 12 is attached to the engine block 16 immediately above the cylinder 14 by means of suitable fasteners, such as bolts, etc., not shown. Although not shown in FIG. 3, conventional gaskets or other seal means may be employed between the body 12 and the engine block 16.

It will be understood that while the present invention is illustrated as comprising a single body 12 for each cylinder 14 of an internal combustion engine, the body may be extended so as to span all of the cylinders of the engine.

The intake and exhaust valve control apparatus 10 is suitable for use with any conventional internal combustion engine, such as a conventional four-cycle engine. A portion of the engine block 16 is shown in FIG. 3. A single cylinder 14 is illustrated in FIG. 3; although it will be understood that the engine on which the apparatus 10 of the present invention may be advantageously employed may include any number of cylinders arranged in any configuration, such as vee or straight block configurations.

As is conventional, a piston 18 is mounted within the cylinder 14 and reciprocates in a four-stroke cycle through intake, compression, power and exhaust strokes. The upper portion of the cylinder 14, denoted by reference number 20, is the combustion chamber of the cylinder 14.

Although not shown in FIG. 3, a spark plug used to ignite the combustible mixture in the combustion chamber 20 may be mounted in any suitable position, such as centrally through the body 12 into the upper portion of the combustion chamber 20 or through the side wall of the engine block 16 into the combustion chamber 20.

As shown in FIG. 3, the body 12 communicates with conventional intake and exhaust manifolds 22 and 24, respectively, which are mounted on top of the body 12. The intake manifold 22 may be one employed in any conventional engine construction, such as a fuel injected engine using throttle body or direct fuel injection, as well as a conventional carbureted engine.

As shown in FIGS. 1, 2 and 3, the body 12 includes two substantially horizontally extending bores 26 and 28 which extend completely through the body 12 and are arranged side-by-side. Bearings 30 and 32 are mounted in enlarged, annular recesses in the body 12 at both ends of each of the bores 26 and 28. The bearings 30 and 32 may be formed of any conventional bearing, such as a roller bearing, needle bearing, etc. The bearings 30 and 32 rotatably support valves in the body 12 as described in greater detail hereafter.

As shown in FIG. 3, the body 12 is formed with a pair of inlet ports 34 and 36 and a pair of outlet ports 38 and 40 which are respectively aligned with the inlet ports 34 and 36. The inlet ports 34 and 36 communicate with the intake and exhaust manifolds 22 and 24, respectively; while the outlet ports 38 and 40 are disposed in fluid flow communication with the combustion chamber 20 of the cylinder 14.

Two identical valves 42 and 44 are respectively mounted in the bores 26 and 28 in the body 12. Since each of the valves 42 and 44 is identically constructed, the following description will be made only with respect to the valve 42. It will be understood that the valve 44 is identically constructed to the valve 42.

Figure 4:
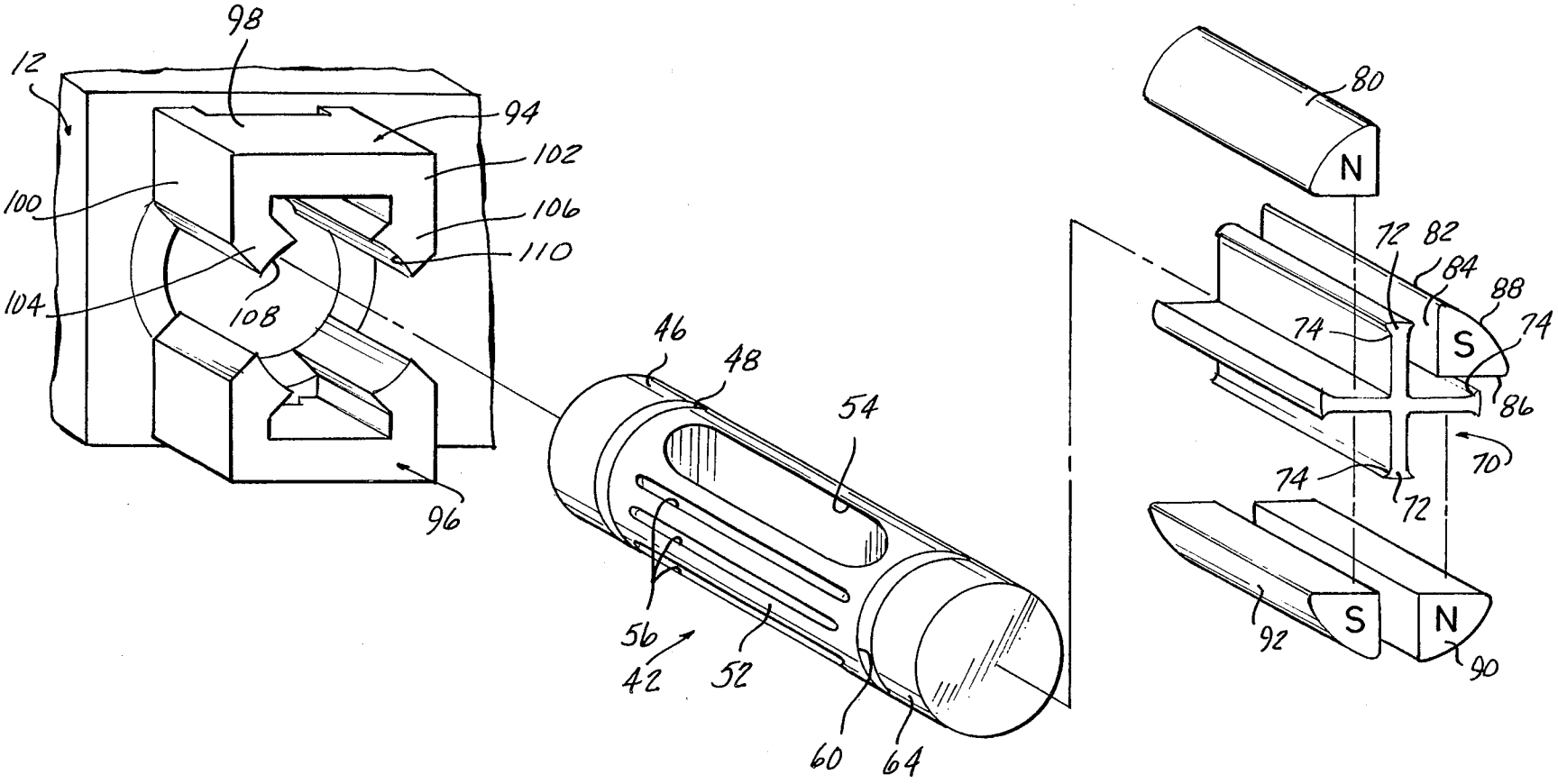
FIG. 4 is an exploded, perspective view of the present invention.

The valve 42, as shown in FIGS. 1, 3 and 4, is formed of any suitable material, such as a ceramic, as well as metals which are cast, machined, etc., to the desired shape. The valve 42 has a generally cylindrical, tubular shape having a first annular end portion 46 which rotatably seats within the bearing 32 in the body 12. A first annular recess 48 is disposed adjacent to the first end portion 46 and receives a suitable seal, such as an O-ring 50, FIG. 2, which limits gas blow-by from the valve 42. A central, tubular portion 52 is formed adjacent the first annular recess 48. The central portion 52 includes a through bore 54 which extends completely through the valve 42 and is oriented substantially perpendicular to the axial length of the valve 42. The bore 54 has a generally elongated, oblong shape, as shown in FIGS. 2 and 4. Other shapes may also be provided for the through bore 54 as desired for efficient fuel or fluid flow.

A plurality of axially extending slots 56 are formed in the side walls of the central portion 52 of the valve 42. The slots 56 receive axial compression seal members 58, shown in FIG. 3, which seal the valve 42 in the bore 26 in the body 12 and enhance compression efficiency. It should be noted that the slots 56 are formed on opposite sides of the bore 54 in the side walls of the central portion 52.

A second annular recess 60 is located adjacent the opposite end of the central portion 52 and receives a second seal member 62, such as an O-ring, FIG. 2. Finally, a second end portion 64 is formed adjacent the second annular recess 60. The second end portion 64 rotatably seats within the bearing 30 in the body 12.

An armature 70, FIGS. 1, 2 and 4, is mounted on the end of the second end portion 64 of the valve 42. The armature 70 may be fixedly attached to the second end portion 64 by suitable means, such as by welding, etc.

Alternately, the armature 70 may be integrally formed with the valve 42. The armature 70 includes four circumferentially spaced, substantially perpendicularly oriented flanges, all of which are denoted by the same reference number 72. The flanges 72 have a generally planar shape except for an outer edge which is slightly curved as shown by reference number 74. This curved end portion 74 forms a mechanical lock for securely retaining a magnet in the armature 70, as described hereafter. The flanges 72 are integrally joined at a center edge, as shown in FIG. 4, and extend radially outward from the joined center edge. When the valve 42 is disposed in the body 12, the armature 70 extends outward from the exterior of the body 12, as shown in FIG. 2.

Magnet means are mounted in the armature 70. Preferably, the magnet means comprises at least one pair of magnets 80 and 82 which have opposed polarity as indicated by the letters "N" and "S" in FIGS. 1 and 4. The magnets 80 and 82 are preferably permanent magnets and have the shape illustrated in FIG. 4 which includes two planar, perpendicular faces 84 and 86 and an arcuate outer surface 88. The planar faces 84 and 86 are adapted to seat on certain of the flanges 72 in the armature 70, with the arcuate surface 88 facing outward from the armature 70. The magnets 80 and 82 are mounted on the armature 70 by suitable means, such as by means of an adhesive, welding, fasteners, etc.

In a preferred embodiment, two pairs of magnets, each pair being of the same polarity and opposed to the polarity of the opposite pair are mounted in the armature 70. Thus, a first pair of magnets 80 and 90, each of the same polarity, are mounted in the armature 70 radially across from each other as shown in FIGS. 1 and 4. The second pair of magnets 82 and 92 are of the same polarity, but opposed to the polarity of the magnets 80 and 90, also mounted on the armature 70 radially across from each other and interspersed between the magnets 80 and 90. This forms a magnetic structure extending circumferentially about the armature 70 which alternates in polarity.

As shown in FIGS. 1, 2 and 4, magnetic cores 94 and 96 are mounted on the body 12 and surround the armature 70 and the magnets 80, 82, 90 and 92. The magnetic cores 94 and 96 are identically constructed and may be formed of any suitable magnetic material, such as powdered magnetic particles pressed or molded to the desired shape. Alternately, each magnetic core 94 and 96 may be formed of stacked laminations of magnetic material.

As noted above, the magnetic cores 94 and 96 are identically constructed; but are mounted in opposed, inverted orientation with respect to each other on one of the side walls of the body 12. Each of the magnetic cores 94 and 96, such as the magnetic core 94, includes a central end portion 98 and two, spaced side legs 100 and 102 which depend from the central end portion 98. Each of the legs 100 and 102 has an angularly extending end 104 and 106, respectively, which angles inward toward the opposite leg and terminates in a face 108 and 110, respectively. The faces 108 and 110 have a concave, annular shape complementary to the shape of the arcuate exterior surface of the magnets 80, 82, 90 and 92. The faces 108 and 110 are disposed in close proximity with the magnets 80 and 82, as shown in FIG. 1. Field coils 112 are wound in a plurality of winding turns about the central end portion 98 of each of the magnetic cores 94 and 96. The size of conductor employed to form the coils 112 and number of turns about the magnetic cores 94 and 96 are selected to meet the needs of a particular application. Each of the coils, such as the coil 112 for the magnetic core 94 and the coil 114 for the magnetic core 96, both of which are associated with the valve 42, are connected to a control means 116 as shown in FIG. 1. The control means or module 116 may comprise any suitable discrete electronic circuit or microprocessor based circuit which executes a control program stored in an internal memory. The control module 116 includes output drivers, such as power transistors, not shown, which supply electric current to the coils 112 and 114 at a predetermined time, for a predetermined time duration, and at a predetermined direction of current flow during the operation of the engine. Timing signals for the timed generation of current are provided to the control module 116 by a main central processing unit or computer 118 which is employed on most current engines. Also input to the control module 116 is the output of a crank sensor 120 which provides an indication of the crank angle of the piston 18 in each cylinder of the engine. Finally, electrical power is connected to the control module 116 for powering the components thereof.

The operation of the intake and exhaust valve control apparatus of the present invention during one complete cycle of the piston 18 in one cylinder 14 of the engine will now be that shown in FIG. 2 in which the valve 42 is positioned such that the bore 54 extends substantially perpendicular to the axial length of the valve 42 and forms a fluid flow path between the inlet port 42 and the outlet port 38 in the body 12 to the combustion chamber 20 in the cylinder 14. This provides a path for the flow of combustible fuel to the cylinder 14 during the intake stroke of the piston 18. The second valve 44 is oriented as shown in FIGS. 2 and 3 in which its bore 54 is disposed substantially perpendicular to the inlet 36 and the outlet 40 in the body 12 to block the fluid flow path between the inlet port 36 and the outlet port 40.

At the completion of the intake stroke of the piston 18, the control module 116 will generate an electric current in the coils 112 and 114 having a predetermined current flow direction. The current flowing in the coils 112 and 114 induces a magnetic field in the respective magnetic cores 94 and 96. The direction of the magnetic field in the cores 94 and 96 is such that the field repels the magnets 80 and 82 from the respective opposed faces 108 and 110 of the magnetic core 94 and attracts the magnets 80 and 82 to the adjacent faces of the magnetic core 94 or the magnetic core 96. Simultaneously, a similar repulsion and attraction is effected by the magnetic core 96 on the magnets 90 and 92. This repulsion and attraction of the magnets 80, 82, 90 and 92 causes a rotation of the valve 42 in a clockwise direction in the example described above causing the bore 54 to assume a blocking position substantially perpendicular to the inlet port 34 and the outlet port 38 in the body 12. This blocks the further intake of fuel into the combustion chamber 20 of the cylinder 14.

At the completion of the power stroke of the piston 18 after the fuel in the combustion chamber 20 has been ignited, the control module 116 supplies an electrical current to the coils of control module 116 supplies an electrical current to the coils of the magnetic cores 94 and 96 associated with the valve 44. These electrical currents induce magnetic fields in the cores 94 and 96 and cause a rotation of the valve 44 approximately 90° until the bore 54 in the valve 44 is oriented substantially vertically and forms a fluid flow path between the inlet port 36 and the outlet port 40 in the body 12 allowing the passage of exhaust gases from the cylinder 14 to the exhaust manifold 24.

The control module 116 generates currents having an opposed direction from that described above to the various coils associated with the valves 42 and 44 to return the valves 42 and 44 to selected blocking or fluid flow positions depending upon the particular point of the engine cycle.

Additional advantageous uses of the intake and exhaust valve control apparatus 10 of the present invention may be obtained by having the control module 116 effectively shut off operation of selected valves, fuel flow and spark in one or more of the bodies mounted on a multiple cylinder engine when the engine is operating at high rpm and low torque demand. Thus, one, two, or more cylinders may be inactivated from operation thereby enhancing fuel economy and reducing wear on the engine. In order to inactivate such cylinders, the control module 116 generates appropriate current signals to selected valves 42 or 44 to position the valve 42 in the fluid flow position shown in FIG. 2 and the valve 44 in the blocking position, also shown in FIG. 2.

In summary, there has been disclosed a unique intake and exhaust valve control apparatus which eliminates substantially all of the mechanical components typically employed in internal combustion engine valve trains. This eliminates substantial weight and volume from an engine as well as reducing the number of components in the engine for a lower manufacturing cost, reduced maintenance and longer life. The intake and exhaust valve control apparatus of the present invention is electrically controlled without any mechanical timing connections to the engine. In addition, this present invention will permit the use of smaller and lighter weight starter motors since a valve in each cylinder can be programmed to remain open at the beginning of the engine cranking cycle, reducing the high starter motor torque requirements. As soon as cranking rpm is established, the valves close and the engine is started.

What is claimed is:

1. An intake and exhaust valve control apparatus for an internal combustion engine having a reciprocal piston mounted in a cylinder, the apparatus comprising:

a body mountable on the engine, the body having inlet and outlet ports extending therethrough disposed in fluid flow communication with the cylinder in the engine;

first and second horizontally extending through bores formed in the body, the first through bore intersecting the inlet port, the second through bore intersecting the exhaust port in the body;

first and second valves rotatably mounted in the first and second through bores, respectively, each of the first and second valves having a through bore extending therethrough substantially perpendicular to the axial length of the valve;

magnet means of opposed polarity mounted on one end of each of the first and second valves;

magnetic core means mounted on the body and disposed in magnetic coupled relationship with the magnet means;

a coil mounted on the magnetic core means for inducing a magnetic field in the magnetic core when electric current flows through the coil; and control means, connected to the coil, for generating an electric current in the coil of one of two opposed directions, for inducing a magnetic field in the magnetic core having one of first and second magnetic field orientations to cause selective rotation of the magnet means and the first and second valve means between first and second positions in which the through bore in each of the first and second valve means alternates between fluid flow communicating and fluid flow blocking positions between the inlet and outlet ports in the body.

2. The apparatus of claim 1 wherein:

the magnet means comprises two radially opposed magnets of a first polarity and two radially opposed magnets of a second polarity, each of the second magnets being interposed between the first pair of magnets;

first and second magnetic core means mounted on the body, the first magnetic core means associated with one of the first and second magnet means, the second magnetic core means associated with the other of the first and second magnet means; and first and second coils respectively associated with the first and second magnetic cores.

3. The apparatus of claim 2 further including:

an armature mounted on one end of each of the first and second valves, the armature including four radially extending flanges; and one of each of the first and second pair of magnet means being disposed between two adjacent flanges in the armature.

4. The apparatus of claim 1 wherein the magnet means comprises permanent magnets.

5. The apparatus of claim 1 wherein each of the first and second valves further comprises:

first and second annular seal means mounted on each of the first and second valves on opposite sides of the through bores in the first and second valves; and axial seal means mounted on each of the first and second valves and extending along the axial length of each of the first and second valves on opposite sides of the through bores in the first and second valves.

6. The apparatus of claim 1 further including:

bearing means mounted in the body adjacent each end of the first and second valves.

7. A rotary valve control apparatus for an internal combustion engine having a piston reciprocally mounted in a cylinder, the rotary valve having a through bore rotating between first and second positions and disposed in fluid flow communication with the cylinder only in one of the first and second positions, the apparatus comprising:

first and second magnets of opposed polarity mounted on the valve in circumferentially spaced relationship;

a magnetic core disposed in magnetic coupling relationship with the first and second magnets;

a coil wound in a plurality of winding turns on the magnetic core; and control means, connected to the coil, for supplying an electric current to the coil in one of first and second opposed directions to induce a magnetic field in the magnetic core having one of first and second magnetic field orientations to cause selective rotation of the magnet means and the valve between first and second positions in which the through bore in the valve moves between fluid flow and fluid blocking positions with respect to the cylinder.

8. The apparatus of claim 7 wherein:

the magnet means comprises two radially opposed magnets of a first polarity and two radially opposed magnets of a second polarity, each of the second magnets being interposed between the first pair of magnets;

first and second magnetic core means mounted on the body, the first magnetic core means associated with one of the first and second magnet means, the second magnetic core means associated with the other of the first and second magnet means; and first and second coils respectively associated with the first and second magnetic cores.

9. The apparatus of claim 8 further including:

an armature mounted on one end of each of the first and second valves, the armature including four radially extending flanges; and one of each of the first and second pair of magnet means being disposed between two adjacent flanges in the armature.

10. The apparatus of claim 7 wherein the magnet means comprise permanent magnets.

* * * * *